US006119960A

United States Patent [19]

Graves

[11] Patent Number: 6,119,960

[45] Date of Patent: Sep. 19, 2000

[54] SOLENOID ACTUATED VALVE AND FUEL INJECTOR USING SAME

[75] Inventor: Jeffrey D. Graves, Chenoa, Ill.

[73] Assignee: Caterpillar Inc., Peoria, Ill.

[21] Appl. No.: 09/074,013

[22] Filed: May 7, 1998

[51] Int. Cl.[7] ..... F02M 47/02

[52] U.S. Cl. ..... 239/92; 239/96; 239/585.2; 251/30.01; 251/129.1; 137/625.65

[58] Field of Search ..... 239/88, 90, 92, 239/96, 584, 585.1, 585.2, 586; 251/129.1, 129.09, 30.01; 137/625.65, 630.14, 630.15, 630.22

[56] References Cited

U.S. PATENT DOCUMENTS

| | | | |
|---|---|---|---|
| 4,129,253 | 12/1978 | Bader, Jr. et al. | 239/88 |
| 4,250,922 | 2/1981 | Will et al. | 137/625.65 |
| 4,310,143 | 1/1982 | Determan | 251/30 |
| 4,527,737 | 7/1985 | Deckard | 239/89 |
| 5,000,420 | 3/1991 | Hendrixon et al. | 251/129.08 |
| 5,006,901 | 4/1991 | Dick | 335/258 |
| 5,042,718 | 8/1991 | Bergmann et al. | 239/88 |
| 5,350,152 | 9/1994 | Hutchinson et al. | 251/30.05 |
| 5,460,329 | 10/1995 | Sturman | 239/96 |
| 5,479,901 | 1/1996 | Gibson et al. | 123/472 |
| 5,709,341 | 1/1998 | Graves | 239/92 |
| 5,878,720 | 3/1999 | Anderson et al. | 123/496 |
| 5,878,782 | 3/1999 | Nakajima | 137/625.65 |
| 5,906,351 | 5/1999 | Aardema et al. | 251/30.01 |

*Primary Examiner*—Andres Kashnikow
*Assistant Examiner*—Lisa Ann Douglas
*Attorney, Agent, or Firm*—Michael B. McNeil

[57] ABSTRACT

A solenoid actuated valve includes a valve body that defines a first passage and a second passage. The solenoid is attached to the valve body and has an armature. A multi-piece valve member is attached to the armature. At least one of the multi-piece valve member and valve body define a small passage and a large passage. The multi-piece valve member has a first configuration in which both the small and large passages are closed. The multi-piece valve member has a second configuration in which the small passage is open between the first passage and the second passage, but the large passage remains closed. The multi-piece valve member has a third configuration in which the large passage is open between the first passage and the second passage. The valve finds a preferred application as a control valve in a hydraulically-actuated fuel injector.

20 Claims, 4 Drawing Sheets

SOLENOID ACTUATED VALVE AND FUEL INJECTOR USING SAME

TECHNICAL FIELD

The present invention relates generally to solenoid actuated valves having a multi-piece valve member, and more particularly to a solenoid actuated control valve for a fuel injector.

BACKGROUND ART

In one class of solenoid actuated fluid valves, there is a desire to have three or more valve configurations that correspond to different flow conditions through the valve. For instance, in some fluid control valves there is a desire to have a first closed configuration, a small open configuration that allows some limited amount of fluid flow through the valve, and a large open condition that allows relatively unrestricted fluid flow through the valve. Such a valve might find potential application in controlling fluid flow to a hydraulically driven piston where there is a desire to control the movement rate or acceleration rate of the piston.

One potential application for a multi configuration control valve might be in hydraulically-actuated fuel injectors that utilize a hydraulically driven intensifier piston to pressurize fuel. In a typical fuel injector of this type, a solenoid actuated control valve has two positions: a closed position and an open position. Thus, hydraulically-actuated fuel injectors typically do not include an intermediate operating condition as they are either fully on or fully off. There might be a motivation to adopt a multi configuration control valve in a hydraulically-actuated fuel injector since engineers are constantly seeking new ways to control injection rate shaping in order to improve combustion efficiency and reduce undesirable noise and exhaust emissions. For instance, engineers have observed that undesirable emissions can sometimes be reduced by creating an injection rate shape that includes a small pilot injection followed by a relatively large main injection. Since there is a strong correlation between the movement rate of the intensifier piston and the injection rate trace from a hydraulically-actuated fuel injector, a multi configuration control valve might provide an additional avenue for controlling injection rate shaping.

The present invention is directed to multi configuration fluid valves and using the same to produce rate shaping in a fuel injector.

DISCLOSURE OF THE INVENTION

A solenoid actuated valve includes a valve body that defines a first passage and a second passage. A solenoid is attached to the valve body and has an armature. A multi-piece valve member is attached to the armature. At least one of the multi-piece valve member and the valve body define a small passage and a large passage. The multi-piece valve member has a first configuration in which the small passage and the large passage are closed. The multi-piece valve member has a second configuration in which the small passage is open between the first passage and the second passage, but the large passage is closed. Finally, the multi-piece valve member has a third configuration in which the large passage is open between the first passage and the second passage.

BEST MODE FOR CARRYING OUT THE INVENTION

Figure 1:
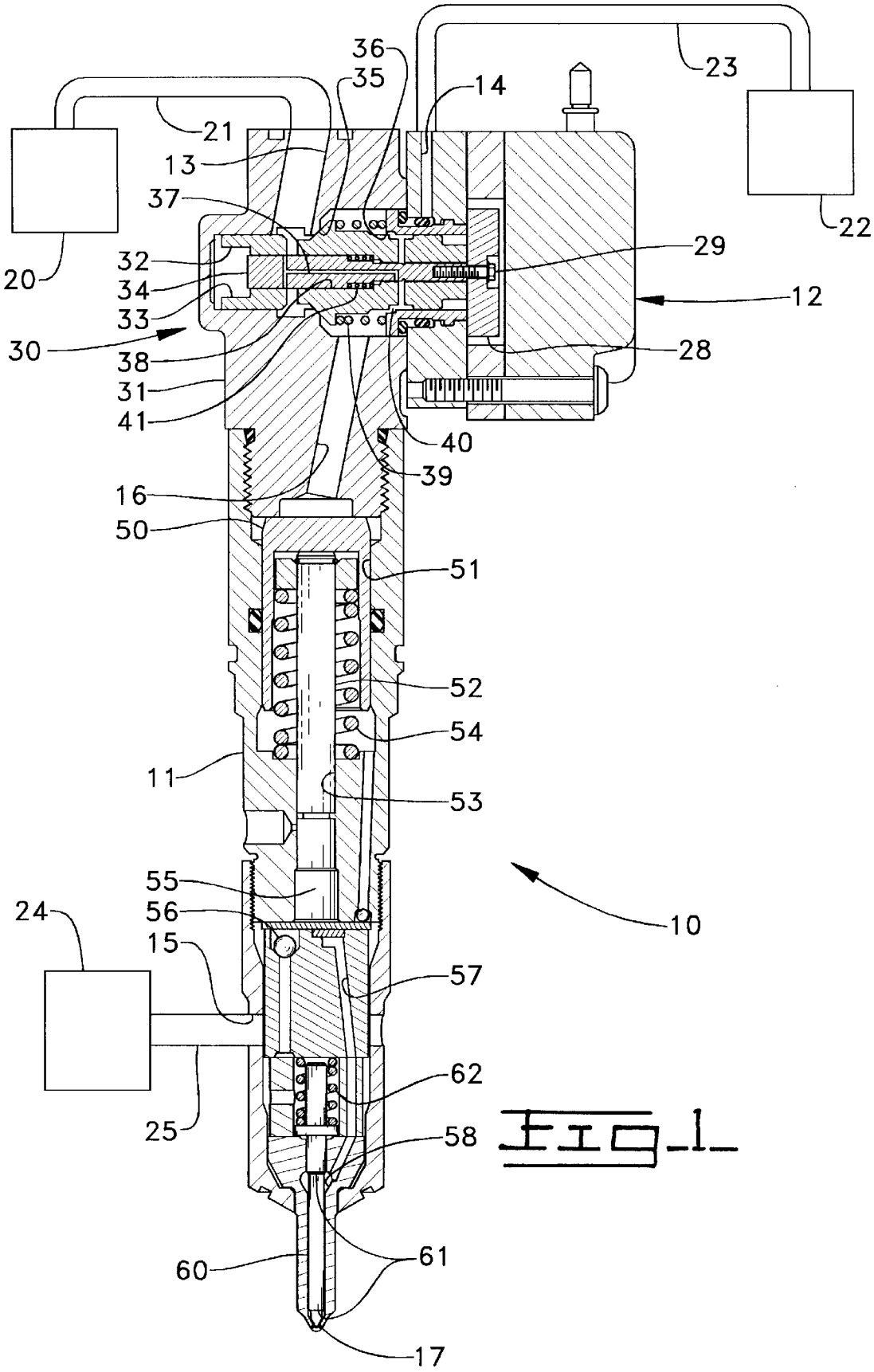
FIG. 1 is a sectioned side diagrammatic view of a fuel injector according to the present invention.
Figure 2:
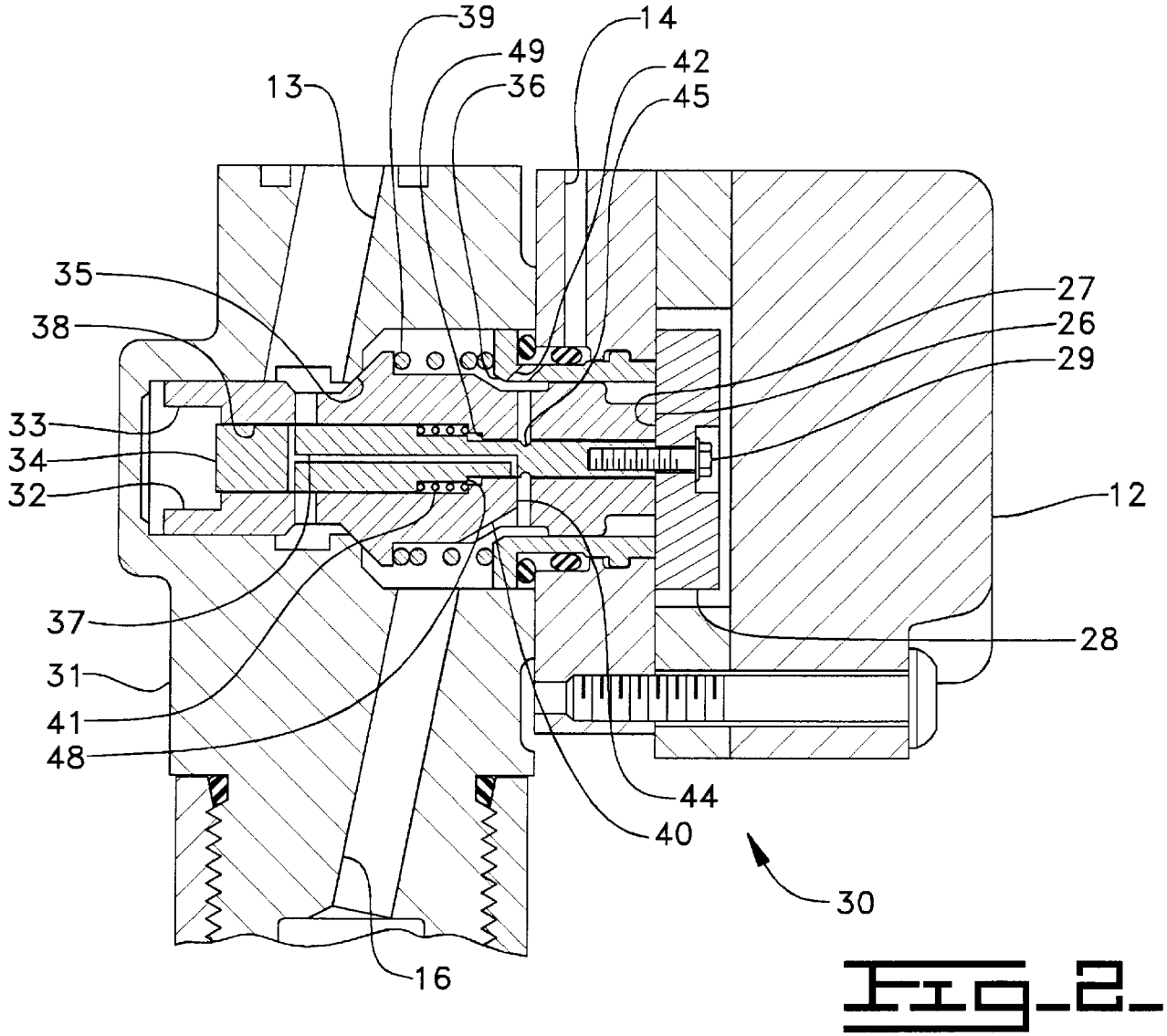
FIG. 2 is an enlarged sectioned side diagrammatic view of the control valve portion of the FIG. 1 fuel injector.

Referring now to FIGS. 1 and 2, a hydraulically-actuated fuel injector 10 includes an injector body 11 to which a solenoid 12 is attached. Injector body 11 defines an actuation fluid inlet 13 (first passage), an actuation fluid drain 14, a fuel inlet 15 and a nozzle outlet 17. Actuation fluid inlet 13 is connected to a source of high pressure actuation fluid 20 via an actuation fluid supply passage 21. Actuation fluid drain 14 is connected to a low pressure return reservoir 22 via a drain line 23. Fuel inlet 15 is connected to a source of medium pressure fuel 24 via a fuel supply passage 25. Nozzle outlet 17 is positioned in a combustion space within an engine (not shown). While the actuation fluid could be any suitable and available liquid, it is preferably pressurized engine lubricating oil. Fuel injector 10 is preferably adapted for use in a diesel type internal combustion engine such that fuel source 24 contains a typical distillate diesel fuel.

The operation of fuel injector 10 is controlled by a solenoid actuated control valve 30 that includes a valve body 31, which is a portion of injector body 11. Control valve 30 includes a multi-piece valve member 32 that alternately connects an actuation fluid cavity 16 to the high pressure of actuation fluid inlet 13 or the low pressure of actuation fluid drain 14. Multi-piece valve member 32 is attached to armature 28 of solenoid 12 via a conventional fastener 29. Multi-piece valve member 32 includes an outer poppet valve member 33 and an inner spool valve member 34, which is attached directly to armature 28 with fastener 29.

FIGS. 1 and 2 show multi-piece valve member 32 in its first configuration in which actuation fluid cavity 16 (second passage) is closed to actuation fluid inlet 13 but open to actuation fluid drain 14 via slot 40, connection passage 44, annulus 45 and drain port 42. When in the first configuration, outer biasing spring 39 biases outer valve member 33 into contact with high pressure seat 35. Inner biasing spring 41 biases inner valve member 34 to a position in which end 26 of outer valve member 33 is in contact with the underside 27 of armature 28.

When solenoid 12 is energized with a low pull-in current, inner valve member 34 moves within guide bore 38 of outer valve member 33 to a position in which annular shoulder 48 is in contact with annular shoulder 49. This solenoid current is chosen to be sufficient to overcome spring 41, but insufficient to compress outer spring 39 so that outer valve member 33 remains stationary to maintain high pressure seat 35 closed. When in its second configuration, small passage 37 connects actuation fluid inlet 13 to actuation fluid cavity 16 via connection passage 44. Simultaneously, annulus 45 moves away from connection passage 44 such that actuation fluid cavity 16 is now closed to actuation fluid drain 14.

When solenoid 12 is energized with a high pull-in current, annular shoulders 48 and 49 remain in contact and outer valve member 33 is pulled to the right where it comes in contact with annular stop 36. When this occurs, a relatively large passage across high pressure seat 35 is opened between actuation fluid inlet 13 and actuation fluid cavity 16. In this case the large passage is defined by the outer surface of valve member 32 and the interior contours of valve body 31. After multi-piece valve member 32 has been moved into this third configuration, current to solenoid 12 can be reduced to a medium hold-in current that keeps outer valve member 33 in contact with annular stop 36, and annular shoulder 48 of inner valve member 34 in contact with annular shoulder 49. When valve member 32 is in its second or third configurations, high pressure actuation fluid flows into cavity 16 to actuate the fuel injector.

Injector body 11 includes a piston bore 51 within which an intensifier piston 50 reciprocates between a retracted position, as shown, and a downward advanced position. One end of intensifier piston 50 is exposed to fluid pressure in actuation fluid cavity 16. Injector body 11 also defines a plunger bore 53 within which a plunger 52 reciprocates between a retracted position, as shown, and a downward advanced position. Plunger 52 is in contact with the underside of intensifier piston 50 such that both move together. Piston 50 and plunger 52 are biased toward their retracted positions by a return spring 54.

A portion of plunger bore 53 and plunger 52 define a fuel pressurization chamber 55 that is connected to nozzle outlet 17 via a nozzle supply passage 57 and a nozzle chamber 58. A needle valve member 60 is positioned in nozzle chamber 58 and is biased downward toward a closed position that blocks nozzle outlet 17 by a needle biasing spring 62. However, when fuel pressure acting on lifting hydraulic surfaces 61 is sufficient to overcome biasing spring 62, needle valve member 60 moves upward to open nozzle outlet 17. Fuel pressure is created within injector 10 when plunger 52 is driven downward by piston 50 to compress the fuel in fuel pressurization chamber 55. When plunger 52 is undergoing its upward return stroke between injection events, fresh fuel is drawn into fuel pressurization chamber 55 past a check valve 56.

Figure 4:
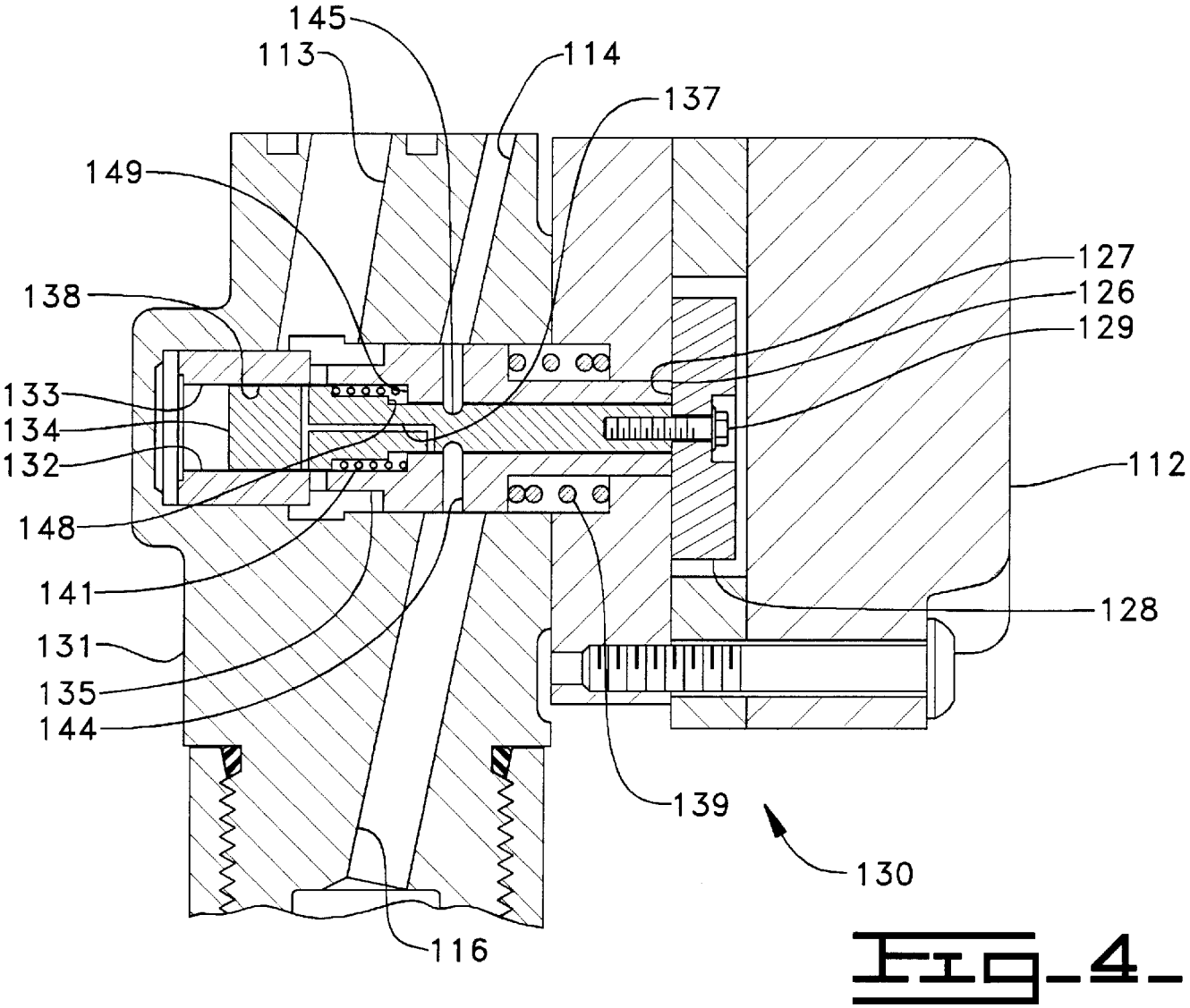
FIG. 4 is an enlarged sectioned side diagrammatic view of a spool within a spool control valve according to another embodiment of the present invention.

Referring now to FIG. 4, an alternative control valve 130 could be substituted in place of the control valve 30 of FIGS. 1 and 2. Control valve 130 performs substantially similar to the earlier embodiment except that in this case, multi valve member 132 is a spool within a spool version, whereas the earlier embodiment was a spool within a poppet embodiment. Control valve 130 includes a valve body 131 that has a solenoid 112 attached thereto. A multi-piece valve member 132 is attached to armature 128 with a screw fastener 129. Multi-piece valve member 132 includes an outer valve member 133 and an inner valve member 134 that is slidably positioned in a guide bore 138.

When solenoid 112 is de-energized, outer biasing spring 139 and inner biasing spring 141 bias multi-piece valve member 132 into its first configuration, as shown, in which actuation fluid cavity 116 is closed to actuation fluid inlet 113 but open to actuation fluid drain 114 via connection passage 144 and annulus 145. When solenoid 12 is energized with its low pull-in current, outer valve member 133 remains stationary, but inner valve member 134 moves to the right in guide bore 138 to a position that connects actuation fluid cavity 116 to actuation fluid inlet 113 via small passage 137. At the same time, annulus 145 moves to the right away from connection passage 144 such that actuation fluid cavity 116 is closed to actuation fluid drain 114. When in this second configuration, inner biasing spring 141 is compressed until annular shoulder 148 comes into contact with annular shoulder 149. When a high pull-in current is applied to solenoid 112, multi-piece valve member 132 moves to the right to assume its third configuration in which annular shoulders 148 and 149 remain in contact and annulus 135 creates a large passage connection between actuation fluid cavity 116 and actuation fluid inlet 113.

Industrial Applicability

Figure 3A:
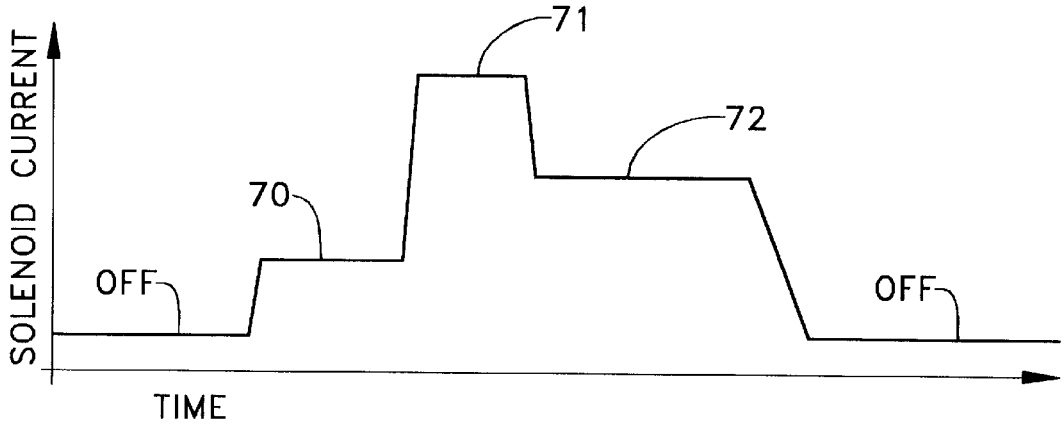
FIGS. 3*a–c* are graphs of solenoid current, valve member position and injection rate trace, respectively, versus time for a sample injection event according to one aspect of the present invention.
Figure 3B:
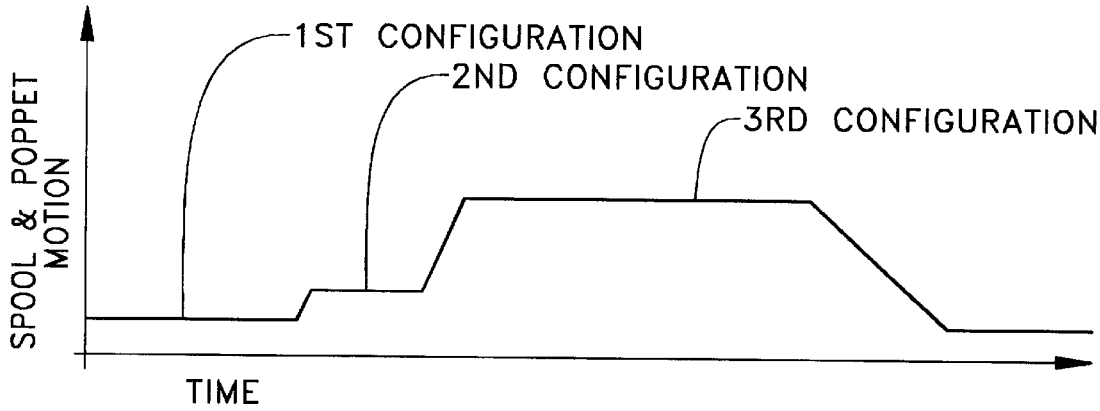
Figure 3C:
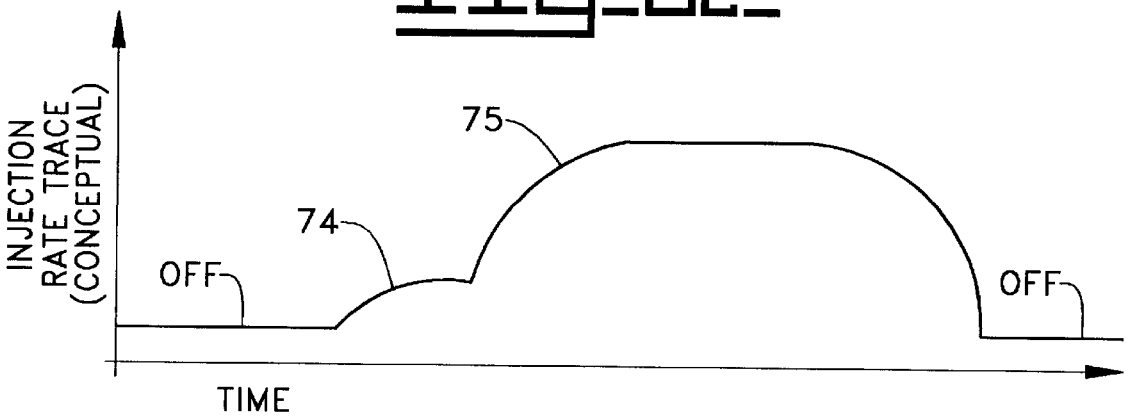

Referring back to FIGS. 1 and 2, and in addition to FIGS. 3*a–c*, each injection event is initiated by applying current to solenoid 12. In the examples shown, a low pull-in current 70 is sufficient to move control 30 from its first configuration, as shown, to its second configuration in which small passage 37 connects actuation fluid inlet 13 to actuation fluid cavity 16. Although small passage 37 is shown as being defined by multi-piece valve member 32 in FIG. 1, those skilled in the art will appreciate that the multi-piece valve member could be modified along with valve body 31 so that the small passage was created on the outer surface of the valve member. Preferably, small passage 37 is sufficiently large that pressure in actuation fluid cavity 16 rises sufficiently to cause intensifier piston 50 to move downward against the action of return spring 54. If small passage 37 is too small, nothing will happen when the control valve moves into its second configuration. On the other hand, if small passage 37 is too large, a large amount of high pressure flow will be allowed to flow into actuation fluid cavity 16, and the fuel injector will perform substantially identical to that of the prior art. Thus, small passage 37 is preferably of the size that allows some small injection rate to occur so that a pilot injection rate trace 74 (FIG. 3*c*) can be created. This relatively low pilot injection rate can be sustained as long as the low pull-in current 70 is applied to the solenoid. Those skilled in the art will appreciate that if a split injection is desired, the solenoid current can be turned off briefly before energizing the solenoid for the main injection event. It is important to note that even if the inner valve member had no small passage 37, the multi-piece valve member would still represent an improvement over prior art poppet valves because there is no position in which the actuation fluid inlet 13 is open to the low pressure actuation fluid drain 14 either through or across the valve member. In prior art poppet valves of this type, the high pressure inlet is briefly open to the low pressure drain when the poppet valve member is moving between its high and low pressure seats.

After a desired pilot injection, a high pull-in current 71 is applied to solenoid 12, which causes the multi-piece valve member to move to its third configuration in which a relatively large flow passage now connects actuation fluid cavity 16 to actuation fluid inlet 13. In the illustrated embodiments, the large passage is defined by the area between the valve member and the inner contours of the valve body, but those skilled in the art will appreciate that the multi-piece valve member 32 could be modified such that the large passage was could be created internally within the valve member. When the large passage connects inlet 13 to cavity 16, a main injection event 75 commences in a conventional manner. Although not necessary, some energy can be conserved by reducing current to the solenoid to a hold-in current 72 after the multi-piece valve member has assumed its third configuration. This current is sufficient to hold the valve in its third configuration. The main injection event is continued as long as either the high pull-in current 71 or the medium hold-in current 72 is sustained on the solenoid. Those skilled in the art will appreciate that an injection event can be created without a pilot injection simply by applying a high pull-in current 71 to the solenoid at the beginning of a desired injection event.

When it is desired to end the injection event, all current to the solenoid is turned off. This causes the inner and outer springs 41 and 39, respectively, to move multi-piece valve member 32 back to its first configuration, as shown, to reconnect actuation fluid cavity 16 to the low pressure of actuation fluid drain 14. When this occurs, intensifier piston 50 and plunger 52 cease their downward movement, and fuel pressure in fuel pressurization chamber 55 quickly drops. This drop in fuel pressure in turn decreases the upward forces holding needle valve member 60 open such that needle valve member 60 begins to move downward under the action of needle biasing spring 62 to its closed position. When this occurs, nozzle outlet 17 closes and the injection event ends. Between injection events, plunger 52 and piston 50 retract upward under the action of return spring 54. This causes the used actuation fluid in actuation fluid cavity 16 is pushed out of fuel injector 10 into drain 23 via actuation fluid drain 14. At the same time, fresh fuel is drawn into fuel inlet 15 and into fuel pressurization chamber 55 past check valve 56.

The graphs of FIGS. 3*a–c* could equally apply to the embodiment of FIG. 4 since it performs substantially identical to the fuel injector illustrated in FIGS. 1 and 2. Because small passages 37 and 137 of the control valves 30 and 130 are relatively small, the initial downward movement rate of intensifier piston 50 can be made to be relatively slow such that only a threshold injection fuel pressure can be sustained. Those skilled in the art will appreciate that in different applications the relative sizing of the small passage to that of the large passage can be adjusted to provide one with the ability to move a hydraulically driven piston at two distinct predetermined rates. In the present example, these respective rates are chosen to produce a pilot injection and main injection events that have predetermined fuel flow rate magnitudes as shown in FIG. 3*c*.

Although the present invention has been illustrated for use as a control valve in a hydraulically-actuated fuel injector, it could also find potential application in some electronically-controlled cam driven fuel injectors. In such a case, injection timing is controlled by opening and closing a fuel spill passage. If the present invention were incorporated into such a fuel injector, a partial spill mode could be used to spill only a portion of fuel but sustain sufficient fuel pressure that a low injection rate occurs when the valve is in its second configuration. When it is time to begin a main injection event, the valve would be moved to its completely closed position so that the full fuel pressure could develop in the cam actuated fuel injector. Thus, the present invention can find potential application in both cam actuated and hydraulically-actuated fuel injectors. In addition, the present invention finds potential application as a valve and any application where there is a desire to precisely control two distinct flow rates through the valve.

The above description is intended for illustrative purposes only, and is not intended to limit the scope of the present invention in any way. For instance, both of the illustrated embodiments show that the large and small passages as two distinct passageways; however, those skilled in the art will appreciate that the valve body and multi-piece valve member could be modified such that the large and small passageways share portions in common but a small flow area is maintained in the valve's second configuration but a large flow area is created when the valve moves to its third configuration. Thus, various modifications could be made to the illustrated embodiments without departing from the spirit and scope of the present invention, which is defined in terms of the claims set forth below.

I claim:

1. A solenoid actuated valve comprising:

a valve body defining a first passage and a second passage;

a solenoid attached to said valve body and having an armature;

a multi-piece valve member attached to said armature;

at least one of said multi-piece valve member and said valve body defining a small passage and a large passage; and said multi-piece valve member having a first configuration in which said small passage and said large passage are closed;

said multi-piece valve member having a second configuration in which said small passage is open between said first passage and said second passage, but said large passage is closed; and said multi-piece valve member having a third configuration in which said large passage is open between said first passage and said second passage.

2. The solenoid actuated valve of claim 1 wherein said multi-piece valve member includes an inner valve member slidably mounted in an outer valve member.

3. The solenoid actuated valve of claim 1 further comprising at least one spring operably positioned to bias said multi-piece valve member toward said first configuration.

4. The solenoid actuated valve of claim 1 wherein said multi-piece valve member includes a poppet valve member movably mounted in said valve body and a spool valve member movably mounted in said poppet valve member.

5. The solenoid actuated valve of claim 1 wherein said multi-piece valve member includes a first spool valve member movably mounted in said valve body and a second spool valve member movably mounted in said first spool valve member.

6. The solenoid actuated valve of claim 1 wherein said small passage passes through said multi-piece valve member.

7. The solenoid actuated valve of claim 1 wherein said multi-piece valve member includes an outer valve member positioned in said valve body and being movable with respect to said valve body between a first position and a second position, and further including an inner valve member attached to said armature and being positioned in said outer valve member and being movable with respect to said outer valve member between a closed position and an open position.

8. The solenoid actuated valve of claim 7 wherein said outer valve member is in said first position and said inner valve member is in said closed position when said multi-piece valve member is in said first configuration;

said outer valve member is in said first position and said inner valve member is in said open position when said multi-piece valve member is in said second configuration; and said outer valve member is in said second position and said inner valve member is in said open position when said multi-piece valve member is in said third configuration.

9. The solenoid actuated valve of claim 7 further comprising:

a first biasing spring operably positioned to bias said outer valve member toward said first position; and a second biasing spring operably positioned to bias said inner valve member toward said closed position.

10. The fuel injector of claim 7 wherein said outer valve member is in said first position and said inner valve member is in said closed position when said multi-piece valve member is in said first configuration;

said outer valve member is in said first position and said inner valve member is in said open position when said multi-piece valve member is in said second configuration; and said outer valve member is in said second position and said inner valve member is in said open position when said multi-piece valve member is in said third configuration.

11. The fuel injector of claim 10 further comprising:

a first biasing spring operably positioned to bias said outer valve member toward said first position; and a second biasing spring operably positioned to bias said inner valve member toward said closed position.

12. The fuel injector of claim 11 wherein said small passage passes through said multi-piece valve member; and said inner valve member is a spool valve member.

13. A fuel injector comprising:

an injector body defining a nozzle outlet, a first passage and a second passage;

a solenoid attached to said injector body and having an armature;

a multi-piece valve member attached to said armature;

at least one of said multi-piece valve member and said injector body defining a small passage and a large passage; and said multi-piece valve member having a first configuration in which said small passage and said large passage are closed;

said multi-piece valve member having a second configuration in which said small passage is open between said first passage and said second passage, but said large passage is closed; and said multi-piece valve member having a third configuration in which said large passage is open between said first passage and said second passage.

14. The fuel injector of claim 13 wherein said multi-piece valve member includes an outer valve member positioned in said injector body and being movable with respect to said injector body between a first position and a second position, and further including an inner valve member attached to said armature and being positioned in said outer valve member and being movable with respect to said outer valve member between a closed position and an open position.

15. A hydraulically actuated fuel injector comprising:

an injector body defining an actuation fluid inlet, an actuation fluid cavity and a nozzle outlet;

a solenoid attached to said injector body and having an armature;

a multi-piece valve member attached to said armature;

at least one of said multi-piece valve member and said injector body defining a small passage and a large passage; and said multi-piece valve member having a first configuration in which said small passage and said large passage are closed;

said multi-piece valve member having a second configuration in which said small passage is open between said actuation fluid inlet and said actuation fluid cavity, but said large passage is closed; and said multi-piece valve member having a third configuration in which said large passage is open between said actuation fluid inlet and said actuation fluid cavity.

16. The hydraulically actuated fuel injector of claim 15 wherein said injector body defines a fuel inlet connected to a source of low pressure fuel; and said actuation fluid inlet is connected to a source of high pressure actuation fluid that is different from said fuel.

17. The hydraulically actuated fuel injector of claim 16 wherein said injector body further defines an actuation fluid drain;

said actuation fluid drain being open to said actuation fluid cavity when said multi-piece valve member is in said first configuration;

said actuation fluid drain being closed to said actuation fluid cavity when said multi-piece valve member is in said second configuration and said third configuration.

18. The hydraulically actuated fuel injector of claim 17 wherein said multi-piece valve member includes an outer valve member positioned in said injector body and being movable with respect to said injector body between a first position and a second position, and further including an inner valve member attached to said armature and being positioned in said outer valve member and being movable with respect to said outer valve member between a closed position and an open position.

19. The hydraulically actuated fuel injector of claim 18 wherein said outer valve member is in said first position and said inner valve member is in said closed position when said multi-piece valve member is in said first configuration;

said outer valve member is in said first position and said inner valve member is in said open position when said multi-piece valve member is in said second configuration; and said outer valve member is in said second position and said inner valve member is in said open position when said multi-piece valve member is in said third configuration.

20. The hydraulically actuated fuel injector of claim 19 further comprising:

a first biasing spring operably positioned to bias said outer valve member toward said first position; and a second biasing spring operably positioned to bias said inner valve member toward said closed position.

* * * * *